US008100396B2

(12) United States Patent
Newland et al.

(10) Patent No.: US 8,100,396 B2
(45) Date of Patent: Jan. 24, 2012

(54) MEDIA SHEET EXIT BAFFLE

(75) Inventors: Paul Newland, Market Harborough (GB); Nicola Bianco, Great Barford (GB); Colin Partridge, Hertfordshire (GB); Richard Bridges, London (GB)

(73) Assignee: Xerox Corporation, Norwalk, CT (US)

( * ) Notice: Subject to any disclaimer, the term of this patent is extended or adjusted under 35 U.S.C. 154(b) by 106 days.

(21) Appl. No.: 12/425,747

(22) Filed: Apr. 17, 2009

(65) Prior Publication Data

US 2010/0264578 A1 Oct. 21, 2010

(51) Int. Cl.
*B65H 5/00* (2006.01)

(52) U.S. Cl. ..... 271/10.01; 271/145

(58) Field of Classification Search ..... 271/4.01, 271/4.08, 4.09, 4.1, 10.01, 10.09, 10.1, 10.11, 271/145

See application file for complete search history.

(56) References Cited

U.S. PATENT DOCUMENTS

| | | | | |
|---|---|---|---|---|
| 5,326,091 | A * | 7/1994 | Giacometto et al. | 271/10.01 |
| 5,839,015 | A | 11/1998 | Faguy et al. | |
| 6,129,347 | A * | 10/2000 | Brooks et al. | 271/22 |
| 6,296,244 | B1 | 10/2001 | Hanks et al. | |
| 7,300,050 | B2 * | 11/2007 | Murakami et al. | 271/162 |
| 2006/0071422 | A1 * | 4/2006 | Klein et al. | 271/274 |
| 2006/0088346 | A1 | 4/2006 | Swanson | |

* cited by examiner

*Primary Examiner* — Michael McCullough
(74) *Attorney, Agent, or Firm* — Maginot, Moore & Beck, LLP

(57) ABSTRACT

An apparatus for directing media sheets from a media tray to a feed roller may be coupled to a feeder module. The apparatus includes a support member, a coupler, and a media director. The support member extends across a portion of a media tray width. The coupler extends from the support member and is configured to engage a feeder module to install the support member in a printer. The media director extends from the support member, and is configured to direct a leading edge of a media sheet moving from the media tray towards a feeder nip in the feeder module. The media director is vertically displaced from the support member and the coupler.

10 Claims, 2 Drawing Sheets

MEDIA SHEET EXIT BAFFLE

TECHNICAL FIELD

The apparatus and method described below relate to media sheet exit baffles that direct media sheets from a media tray within a printer and, more particularly, to media sheet exit baffles that are coupled to a feeder module.

BACKGROUND

During the printing cycle of a typical printer a media transport system retrieves media sheets from an input tray, routes the media sheets along a media path to receive and fix an image on the media sheets, and transports the media sheets to an output tray or bin for collection by a user. The input media tray of some printers supports a stack of media sheets. In particular, the input media tray may include springs and a pressure plate configured to urge the media stack upward against a stripper roller, which strips media sheets from the top of the media stack. As the stripper roller strips media sheets from the media stack the springs force the pressure plate upward to keep the top of the media stack in contact with the stripper roller.

In order to route the stripped media sheets from the media stack to the media path some printers include an input media tray exit baffle. The exit baffle guides the media sheets stripped from the media stack into contact with a feed roller that propels the stripped media sheets along the media path. The exit baffle may be properly aligned with the feed roller to enable the feed roller to propel media sheets along the media path efficiently. To this end, known exit baffles and feed rollers are often fixedly mounted to a frame of the printer. The position of the exit baffle relative the feed roller is held constant by the rigidity of the printer frame.

Known exit baffles and feed rollers work well; however, known exit baffles may become improperly aligned with a feed roller when coupled to a printer having a feeder module. Specifically, some printers include feeder modules that combine the feed roller and stripper roller into a modular unit that may be removably coupled to the printer frame. Due to machine tolerances, the feed roller may not be positioned in exactly the same location each time the feeder module is coupled to the printer frame. Accordingly, the precision with which the exit baffle is aligned with the feed roller may be reduced when a printer employs a feeder module.

SUMMARY

An apparatus for directing media sheets from a media tray to a feed roller may be coupled to a feeder module. The apparatus includes a support member, a coupler, and a media director. The support member extends across a portion of a media tray width. The coupler extends from the support member and is configured to engage a feeder module to install the support member in a printer. The media director extends from the support member, and is configured to direct a leading edge of a media sheet moving from the media tray towards a feeder nip in the feeder module. The media director is vertically displaced from the support member and the coupler.

A printer for applying and fixing an image on a media sheet may include an exit baffle for directing media sheets from a media tray to a feeder module. The printer includes a feeder module, a media tray, and an exit baffle. The feeder module is removably coupled to a printer frame, and is configured to strip media sheets from a stack of media sheets. The media tray is coupled to the printer frame and is configured to maintain contact between the stack of media sheets and the feeder module. The exit baffle directs media sheets from the stack of media sheets to the feeder module. The exit baffle includes a support member, a coupler, and media director. The support member extends across a portion of a media tray width. The coupler extends from the support member and is configured to engage the feeder module to install the support member in the printer. The media director extends from the support member and is configured to direct a leading edge of a media sheet moving from the stack of media sheets towards a feeder nip of the feeder module. The media director is vertically displaced from the support member and the coupler.

A method of directing a media sheet from a media stack to a feeder module in a printer includes coupling an exit baffle to a feeder module, with a portion of the exit baffle configured to be positioned a predetermined distance from a portion of the feeder module. The method also includes coupling the feeder module to a printer frame and stripping a media sheet from a media stack supported by a media tray with a stripper roller of the feeder module. Additionally, the method includes guiding the stripped media sheet with the exit baffle into a feeder nip of the feeder module, and propelling the media sheet along a media path with a roller pair of the feeder module.

DETAILED DESCRIPTION

Figure 1:
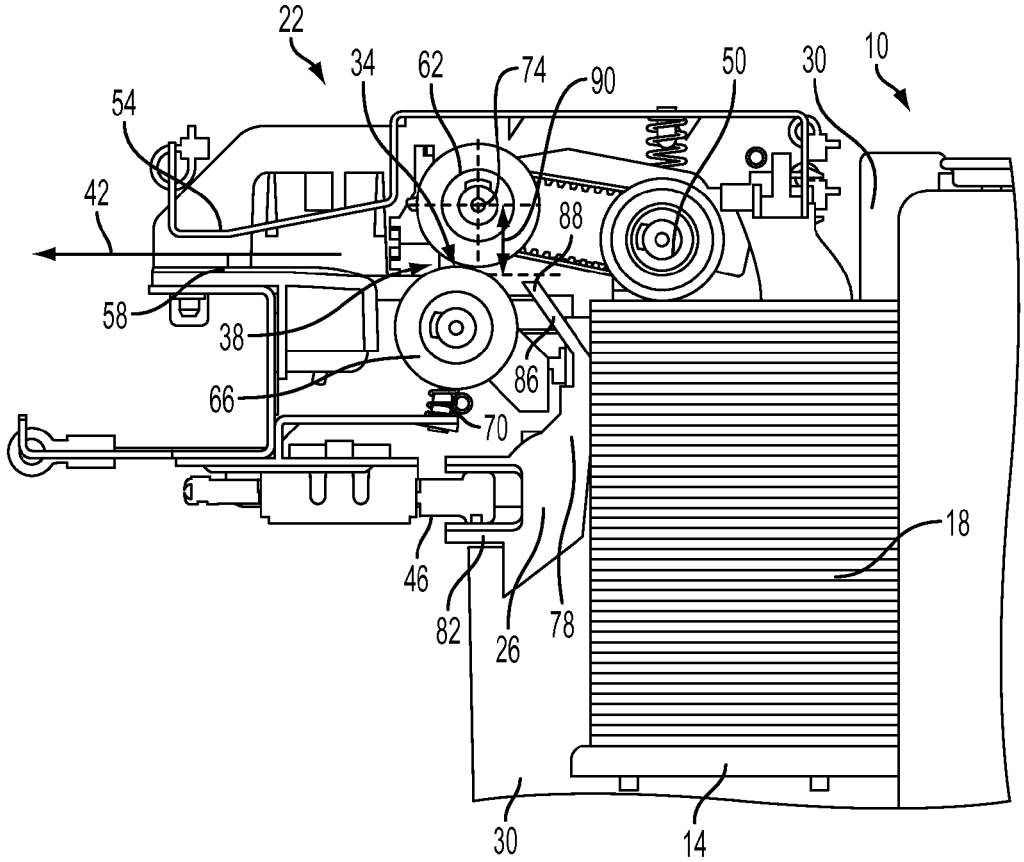
FIG. 1 illustrates a side elevational view of an exit baffle coupled to a feeder module that has been secured to a printer.

The exit baffle described herein is suitable for use with a printer. The term "printer" refers, for example, to reproduction devices in general, such as printers, facsimile machines, copiers, and related multi-function products. FIG. 1 illustrates a portion of a printer 10 for applying and fixing an image upon a media sheet. The printer 10 includes, among other components, a media tray 14, a stack of media sheets 18, a feeder module 22, and an exit baffle 26. Typically, the media tray 14 is coupled to a printer frame 30 and is configured to lift the media stack 18 into contact with the feeder module 22, which strips media sheets from the top of the media stack 18. As a media sheet is stripped from the media stack 18 the leading edge of the stripped media sheet is guided by the exit baffle 26 into a feeder nip 34 of a roller pair 38 coupled to the feeder module 22. Once in contact with the feeder nip 34 the roller pair 38 propels the media sheet along a media path 42, which leads to the other printer components, such as the print imager (not illustrated). After the print imager applies and fixes an image on the media sheet, the printer 10 ejects the media sheet into an output media tray (not illustrated).

As mentioned above, the feeder module 22 strips media sheets from the media stack 18 and propels or feeds the stripped media sheets into the media path 42 of the printer 10. The feeder module 22 may be removably coupled to the printer frame 30 with at least one location pin 46. The location pins 46 may be provided as rods or posts formed of materials including, but not limited to, injection moldable thermoplastics, carbon fiber, metal, metallic alloys, and composite materials. The printer frame 30 may include at least one receiver (not illustrated) for accepting the location pins 46. When the location pins 46 have been accepted by the receivers the feeder module 22 may be properly coupled the printer 10.

The feeder module 22 includes a stripper roller 50, a roller pair 38, and at least two media guide surfaces 54, 58. The stripper roller 50 contacts the top of the media stack 18 and is coupled to a source of rotation, such as an electric motor. As the stripper roller 50 rotates it draws a single media sheet from the top of the media stack 18 and propels the media sheet toward the roller pair 38. To compensate for the variable height of the media stack 18, the stripper roller 50 is pivotally coupled to the feeder module 22 and is biased against the top of the media stack 18.

The roller pair 38 of the feeder module 22 receives the media sheets stripped from the media stack 18 and propels the media sheets along the media path 42. The roller pair 38 includes a drive roller 62, an idler roller 66, and a biasing member 70. The drive roller 62 is rotatably coupled to the feeder module 22 about a stationary rotational axis 74. The rotational output of an electric motor is coupled to the drive roller 62 to rotate the drive roller 62. The same electric motor may be coupled to the drive roller 62 and the stripper roller 50 to enable the drive roller 62 and the stripper roller 50 to rotate simultaneously. The idler roller 66 couples a media sheet to the drive roller 62. In particular, the idler roller 66 is biased against the drive roller 62 with a biasing member 70. The idler roller 66 couples a media sheet to the drive roller 62 by pressing the media sheet against the rotating drive roller 62. To compensate for different types of media sheets, the idler roller 66 may become displaced from the drive roller 62 in response to a media sheet entering the junction of the roller pair 38.

The junction of the idler roller 66 and the drive roller 62 is referred to as a feeder nip 34. When a media sheet contacts the feeder nip 34 it becomes frictionally engaged by the roller pair 38 and is propelled along the media path 42. As a media sheet exits the roller pair 38 it may contact the upper media guide surface 54 and the lower media guide surface 58. The media guide surfaces 54, 58 guide media sheets along the media path 42 without catching, snagging, or jamming, the media sheets.

Figure 2:
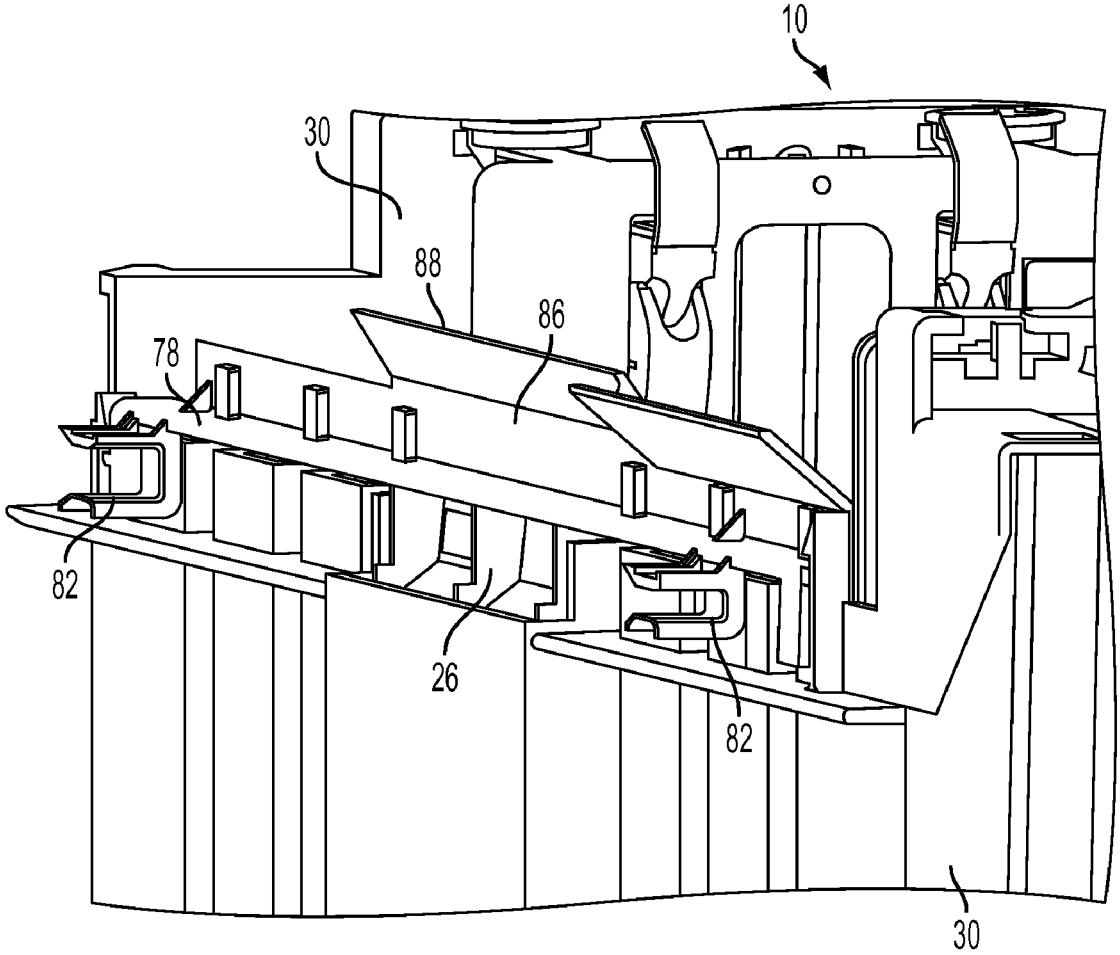
FIG. 2 illustrates a perspective view of the exit baffle and printer of FIG. 1.

As illustrated in FIG. 1 and FIG. 2, the exit baffle 26 guides media sheets from the media stack 18 to the feeder nip 34. The exit baffle 26 may be installed in a printer 10 by coupling the exit baffle 26 to the feeder module 22 and then coupling the feeder module 22 to the printer 10. To ensure that media sheets are efficiently guided into the feeder nip 34, the exit baffle 26 may be precisely positioned relative a portion of the feeder module 22. Specifically, by coupling the exit baffle 26 to the feeder module 22 the position of the exit baffle 26 relative the rotational axis 74 of the drive roller 62 may be precisely configured, as explained in detail below.

The exit baffle 26 includes a support member 78, a coupler 82, and a media director 86. Materials suitable to form the support member 78, coupler 82, and media director 86 include, but are not limited to, injection moldable plastics, carbon fiber, metal, metallic alloys, and composite materials. Each component of the exit baffle 26 may be separately made and coupled together. Alternatively, each component of the exit baffle 26 may be made or formed from a single piece of material to provide an exit baffle 26 in which the components are integral with each other.

Referring to FIG. 2, the support member 78 is the portion of the exit baffle 26 to which the coupler 82 and the media director 86 are coupled or connected. As illustrated, the support member 78 is a linear member; however, the support member 78 may have a nonlinear or irregular shape as required by the printer frame 30, the feeder module 22, the couplers 82, or the media director 86. Additionally, the support member 78 may have a width that extends across a portion of the width of the media tray 14. However, the width of the support member 78 may be wider or narrower than the media tray 14 depending on the embodiment.

The coupler 82 engages the feeder module 22 to install the support member 78 in the printer 10. The coupler 82 is coupled or connected to the support member 78, and may be made of the same material as the support member 78. As illustrated in FIG. 1 and FIG. 2, the coupler 82 may be provided as a bracket configured to engage the location pins 46 of the feeder module 22. Specifically, the bracket may include an upper portion and a lower portion separated by a distance approximately equal to the height of the location pins 46. As the location pins 46 are inserted into the brackets the brackets apply a compressive force upon the pins 46 that couples the support member 78 to the feeder module 22. Alternatively, the coupler 82 may be provided as a hook configured to the engage the location pins 46 of the feeder module 22. The exit baffle 26 may include any type of coupler 82 capable of coupling the support member 78 to the feeder module 22 with the media director 86 located a predetermined distance from a portion of the feeder module 22.

The media director 86 guides media sheets stripped from the media stack 18 into the feeder nip 34 of the roller pair 38. The media director 86 is coupled to and is vertically displaced from the support member 78. The media director 86 may be made of the same materials as the support member 78. The media director is configured to guide the leading edge of a media sheet smoothly into contact with the feeder nip 34. The media director 86 may be a unitary surface that extends across the width of the media tray 14. Alternatively, the media director 86 may have a plurality of guiding surfaces that in combination either partially or fully extend across the width of the media tray 14. Furthermore, the media director 86 may be a ramp vertically displaced from the support member 78. In particular, the ramp may have at least one inclined surface having a low point near the media stack 18 and a high point near the feeder nip 34. Other types of media directors 86 may also be used including media directors 86 having a curved shape.

When the exit baffle 26 is coupled to the feeder module 22 the media director 86 may be located a predetermined distance from a portion of the feeder module 22. In particular, the media director 86 may be positioned a predetermined distance from the feeder nip 34 when the coupler 82 is engaged with the feeder module 22. The predetermined distance may extend from a tip 88 to the feeder nip 34. Alternatively, the predetermined distance may extend from the tip 88 to the axis of rotation 74 of the drive roller 62. Specifically, the predetermined distance, as illustrated by distance 90 of FIG. 1, may be a vertical distance measured from the axis of rotation 74 of the drive roller 62 to a horizontal line defining the tip 88. In each embodiment, when the support member 78 is coupled to the feeder module 22 the media director 86 may be properly positioned relative the feeder nip 34 to guide media sheets stripped from the media stack 18 into the feeder nip 34 efficiently.

In operation, the exit baffle 26 may be coupled to a feeder module 22 by engaging the location pins 46 of the feeder module 22 with the couplers 82 of the exit baffle 26. By simply coupling the exit baffle 26 to the feeder module 22 the position of the media director 86 relative to a portion of the feeder module 22 is precisely established. In particular, the tip 88 may be located a distance equal to predetermined distance 90 from the axis of rotation 74 of the drive roller 62. Next, the feeder module 22 may be coupled to the printer 10 using the location pins 46 or an alternative coupling method such as hooks, brackets, or clasps. Once the feeder module 22 is coupled to the printer 10 the media tray 14 may lift the stack of media sheets until the media stack 18 contacts the stripper roller 50.

To begin a printing cycle, the printer 10 may activate the electric motor coupled to the drive roller 62 and the stripper roller 50 causing the stripper roller 50 to strip a media sheet from the top of the media stack 18. Continued rotation of the stripper roller 50 causes the leading edge of the media sheet to contact the media director 86. Still further rotation of the stripper roller 50 causes the leading edge of the media sheet to slide over the tip 88. In particular, due to the precise location of the media director 86 relative the feeder nip 34, as the media sheet slides over the media director 86 the leading edge of the media sheet is precisely guided into contact with the feeder nip 34. Once the media sheet contacts the feeder nip 34 the roller pair 38 grasps and propels the media sheet along the media path 42 defined by the media guide surfaces 54, 58. The media path 42 may lead to a print imager for applying and fixing an image upon the media sheet.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus for directing media sheets from a media tray comprising:

a support member that extends across at least a portion of a width of the media tray, which is internal to a printer frame of a printer;

a bracket extending from the support member, the bracket having a U-shaped opening with an upper portion and a lower portion separated by a distance that corresponds to a height of a pin extending from a feeder module to enable the bracket to apply a compressive force to a portion of the pin positioned within the bracket between the upper portion and lower portion of the bracket to install the support member in the printer at a position between the feeder module and the media tray to enable the feeder module to move media sheets received from the media tray to a media path within the printer frame; and a media director extending from the support member, the media director configured to direct a leading edge of a media sheet moving from the media tray toward a feeder nip of the feeder module, the media director being vertically displaced from the support member and the bracket.

2. The apparatus of claim 1, the media director being a ramp having at least one inclined surface.

3. The apparatus of claim 1, the media director further configured to be positioned a predetermined distance from the feeder nip when the portion of the in extending from the feeder module is within the bracket.

4. The apparatus of claim 1, the media director further configured to be positioned a predetermined vertical distance from an axis of rotation of a roller of the feeder nip when the portion of the in extending from the feeder module is within the bracket.

5. The apparatus of claim 1 wherein the support member, the bracket, and the media director are formed from the same material.

6. A printer for applying and fixing an image on a media sheet comprising:

a feeder module configured for removable coupling to a printer frame and to strip media sheets from a stack of media sheets, the feeder module having a pin that extends from the feeder module towards the stack of media sheets;

a media tray coupled to the printer frame to support the stack of media sheets within the printer frame, the media tray configured to maintain contact between the stack of media sheets and the feeder module; and an exit baffle configured to direct media sheets stripped from the stack of media sheets to the feeder module, the exit baffle comprising:

a support member that extends across a portion of a width of the media tray, a bracket, the bracket having a U-shaped opening with an upper portion and a lower portion separated by a distance that corresponds to a height of the pin extending from the feeder module to enable a portion of the pin positioned within the U-shaped opening of the bracket between the upper portion and lower portion of the bracket to install the support member in the printer at a position between the feeder module and the media tray, and a media director extending from the support member and configured to direct a leading edge of a media sheet stripped from the stack of media sheets towards a feeder nip of the feeder module, the media director being vertically displaced from the support member and the bracket.

7. The printer of claim 6, the media director further configured to be positioned a predetermined distance from the feeder nip when the portion of the in extending from the feeder module is within the bracket.

8. The printer of claim 6, the feeder nip comprising:

a first roller operatively connected to the feeder module and configured to rotate about a fixed axis of rotation;

a second roller secured to the feeder module and mounted parallel to the first roller; and a biasing member configured to urge the second roller toward the first roller.

9. The printer of claim 8, the media director further configured to be positioned a predetermined vertical distance from the axis of rotation of the first roller when the portion of the in extending from the feeder module is within the bracket.

10. The printer of claim 6, the media director being a ramp having at least one inclined surface.

* * * * *